US008899737B2

(12) United States Patent
Webster-Curley et al.

(10) Patent No.: US 8,899,737 B2
(45) Date of Patent: Dec. 2, 2014

(54) METHOD AND APPARATUS FOR CONTROLLING ULTRAVIOLET-CURABLE GEL INK SPREAD OF A PRINTED IMAGE

(75) Inventors: Jacques K. Webster-Curley, Perry, NY (US); Paul McConville, Webster, NY (US); Anthony S. Condello, Webster, NY (US); Lawrence Floyd, Jr., Rochester, NY (US); Fusheng Xu, Webster, NY (US); Bryan Roof, Newark, NY (US); Jason O'Neil, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 173 days.

(21) Appl. No.: 13/529,486

(22) Filed: Jun. 21, 2012

(65) Prior Publication Data

US 2013/0342621 A1 Dec. 26, 2013

(51) Int. Cl.
*B41J 2/01* (2006.01)

(52) U.S. Cl.
USPC ..... 347/102; 347/100; 347/101

(58) Field of Classification Search
CPC ..... B41J 2/01
See application file for complete search history.

(56) References Cited

U.S. PATENT DOCUMENTS 8,043,665 B2 10/2011 Chretien et al.
8,083,338 B2 * 12/2011 Claes et al. ..... 347/100
8,197,024 B2 6/2012 Kovacs et al.
2005/0190248 A1 * 9/2005 Konno et al. ..... 347/102
2006/0214984 A1 * 9/2006 Hirakawa ..... 347/31
2010/0271449 A1 * 10/2010 Kusunoki ..... 347/102
2011/0102491 A1 * 5/2011 Kovacs et al. ..... 347/18
2012/0062666 A1 * 3/2012 Roof et al. ..... 347/102
2012/0320117 A1 * 12/2012 Roof et al. ..... 347/9

OTHER PUBLICATIONS

U.S. Appl. No. 13/160,120, Roof et al., filed Jun. 14, 2011, entitled "Methods, Apparatus, and Systems for UV Gel Ink Spreading".

U.S. Appl. No. 13/195,601, Barton et al., filed Aug. 1, 2011, entitled "Methods, Apparatus, and Systems for Spreading Radiation Curable Gel Ink".

* cited by examiner

*Primary Examiner* — Manish S Shah
*Assistant Examiner* — Jeremy Delozier
(74) *Attorney, Agent, or Firm* — Ronald E. Prass, Jr.; Prass LLP

(57) ABSTRACT

An approach is provided for controlling ultraviolet-curable gel ink spread of a printed image. The approach involves causing, at least in part, one or more inks to be applied to a first substrate image area by one or more inkjets in a printing zone of a printer, the one or more inkjets being configured to form one or more first ink spots on the first substrate image area. The approach also involves determining a temperature of at least the first substrate image area in the printing zone. The approach further involves determining a first spot size of at least one of the one or more first ink spots. The approach additionally involves causing, at least in part, a temperature of at least a second substrate image area in the printing zone to be based, at least in part, on the determined first spot size.

19 Claims, 5 Drawing Sheets

METHOD AND APPARATUS FOR CONTROLLING ULTRAVIOLET-CURABLE GEL INK SPREAD OF A PRINTED IMAGE

FIELD OF DISCLOSURE

The disclosure relates to a method and apparatus for controlling ultraviolet-curable (UV) gel ink spread of a printed image to prevent image defects in a finished print product.

BACKGROUND

Conventional printing processes that use UV-curable gel inks often result in various image related defects such as pin-hole defects and/or lines that resemble a corduroy or vinyl record-like appearance. For example, one significant challenge associated with UV-curable gel ink processes is that such line defects are an inherent byproduct of jetting ink onto a substrate to form an image while the substrate is moving on a media path. Conventional printing processes that use UV-curable gel ink attempt to mitigate line defects by pre-heating the substrate prior to printing or causing reflow of the printed image after printing. But, these attempts to mitigate the line defects are often ineffective or cause pin-hole defects in the image.

SUMMARY

Therefore, there is a need for an approach for controlling UV-curable gel ink spread of a printed image during a printing process.

According to one embodiment, a method for controlling UV-curable gel ink spread of a printed image comprises causing, at least in part, one or more UV-curable gel inks to be applied to a first substrate image area by one or more inkjets in a printing zone of a printer, the one or more inkjets being configured to form one or more first ink spots on the first substrate image area. The method also comprises determining a temperature of at least the first substrate image area in the printing zone. The method further comprises determining a first spot size of at least one of the one or more first ink spots. The method additionally comprises causing, at least in part, a temperature of at least a second substrate image area in the printing zone to be based, at least in part, on the determined first spot size. The method also comprises causing, at least in part, the one or more ultraviolet-curable gel inks to be exposed to an ultraviolet light to cure the one or more ultraviolet-curable gel inks.

According to another embodiment, an apparatus for controlling UV-curable gel ink spread of a printed image comprises at least one processor, and at least one memory including computer program code for one or more computer programs, the at least one memory and the computer program code configured to, with the at least one processor, cause, at least in part, the apparatus to cause, at least in part, one or more UV-curable gel inks to be applied to a first substrate image area by one or more inkjets in a printing zone of a printer, the one or more inkjets being configured to form one or more first ink spots on the first substrate image area. The apparatus is also caused to determine a temperature of at least the first substrate image area in the printing zone. The apparatus is further caused to determine a first spot size of at least one of the one or more first ink spots. The apparatus is additionally caused to cause, at least in part, a temperature of at least a second substrate image area in the printing zone to be based, at least in part, on the determined first spot size. The apparatus is also caused to cause, at least in part, the one or more ultraviolet-curable gel inks to be exposed to an ultraviolet light to cure the one or more ultraviolet-curable gel inks.

According to another embodiment, a computer-readable storage medium carries one or more sequences of one or more instructions for controlling UV-curable gel ink spread of a printed image which, when executed by one or more processors, cause, at least in part, an apparatus to cause, at least in part, one or more UV-curable gel inks to be applied to a first substrate image area by one or more inkjets in a printing zone of a printer, the one or more inkjets being configured to form one or more first ink spots on the first substrate image area. The apparatus is also caused to determine a temperature of at least the first substrate image area in the printing zone. The apparatus is further caused to determine a first spot size of at least one of the one or more first ink spots. The apparatus is additionally caused to cause, at least in part, a temperature of at least a second substrate image area in the printing zone to be based, at least in part, on the determined first spot size. The apparatus is also caused to cause, at least in part, the one or more ultraviolet-curable gel inks to be exposed to an ultraviolet light to cure the one or more ultraviolet-curable gel inks.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method, apparatus, and computer program for controlling UV-curable gel ink spread of a printed image are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

Figure 1:
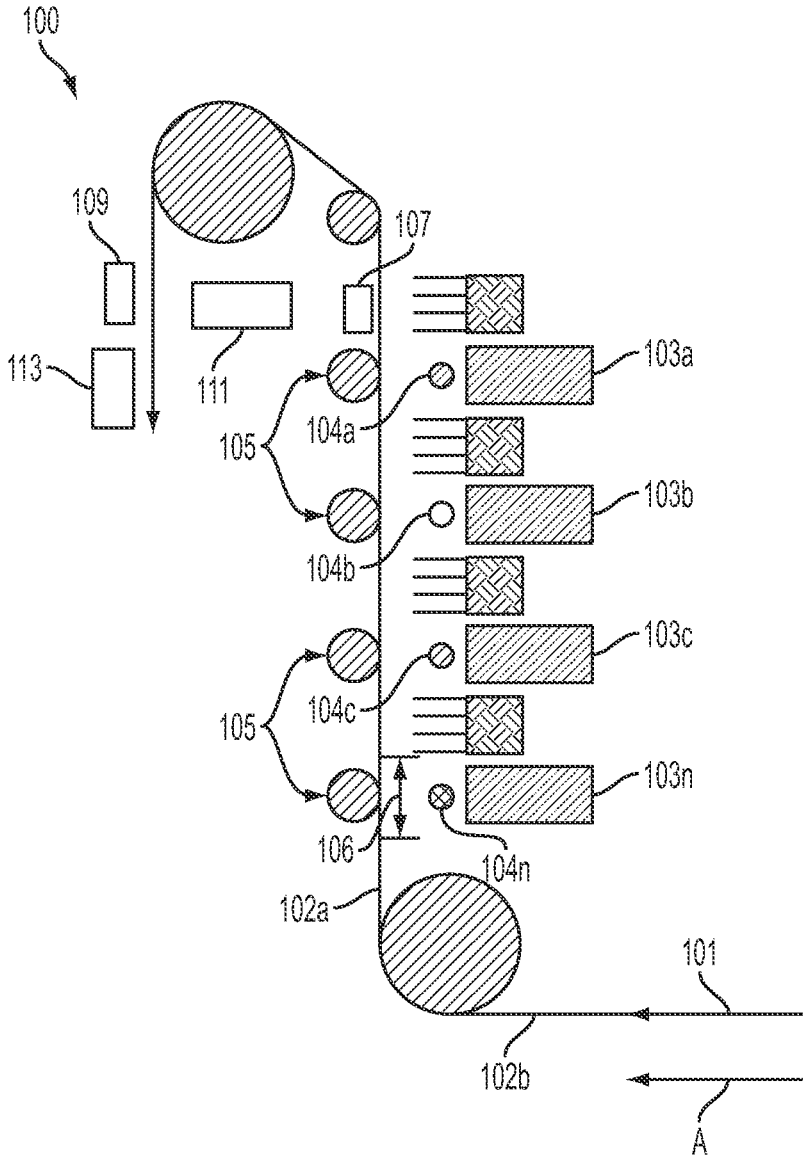
FIG. 1 is a diagram of a system capable of controlling UV-curable gel ink spread of a printed image, according to one embodiment.

FIG. 1 is a diagram of a system capable of controlling UV-curable gel ink spread of a printed image, according to one embodiment. Conventional printing processes using UV-curable gel inks often result in various image related defects such as pin-hole defects and/or lines that resemble a corduroy or vinyl record-like appearance. These image defects often occur in inkjet-type printers based on a number of factors that may include media type and/or coating, temperature, humidity, ink type, etc. Inkjet processes that involve, for example, UV-curable gel ink processes cause such defects because they jet ink onto a substrate to form an image while the substrate is moving on a media path. The UV-curable gel ink is in a gelled form at room temperature, which is often the cause of the above-mentioned image defects because the UV-curable gel ink does not spread like conventional inks. The UV-curable gel ink is subjected to a final curing step to make the applied image permanent.

Conventional printing processes attempt to mitigate line defects before the final curing step by using various types of coated media and/or by pre-heating the substrate prior to printing or causing reflow of the printed image after printing. But, attempts to pre-heat the substrate and/or to reflow the printed image to mitigate the line defects often cause further pin-hole defects in the image. Additionally, coated media is very costly compared to uncoated media, and may not be completely effective at reducing the above-mentioned image defects. Although some coated media still exhibits the image quality defects discussed above, the appearance of these image quality defects less apparent than they image quality defects would be on less expensive uncoated media.

To address these problems, a system 100 of FIG. 1 introduces the capability to control UV-curable gel ink spread of a printed image during a printing process and regardless of the type of media upon which the UV-curable gel ink is applied. The system 100 is configured to control the temperature of a media upon which an image is to be printed during a time at which the system 100 causes the image to be applied by one or more inkjets to the media in a printing zone. By controlling the temperature of the media in the printing zone, the system 100 promotes proper ink spread to reduce image quality defects such as pin-holes and the corduroy effect discussed above.

As shown in FIG. 1, the system 100 is a printing system that prints one or more ink images onto a substrate 101. In one or more embodiments, the substrate 101 may be any media that may be in either a continuous webbed form or an infinite number of sheets in sheeted form. As will be discussed in more detail below, the substrate 101 moves through the system 100 in a process direction A. As the substrate 101 is advanced through the system 100, a first image is applied to a first image area 102*a* of the substrate 101 and then subsequently another image is applied to a second image area 102*b* of the substrate 101. As such, it should be understood that as the system 100 continually prints images onto the substrate 101, regardless of whether the substrate 101 is in webbed or sheeted form, any prior image may be applied to the first image area 102*a* and any latter image may be applied to the second image area 102*b*. Accordingly, regardless of how many images are applied to the substrate 101, or how many sheets of substrate 101 are processed by the system 100, there may be an infinite number of first image areas 102*a* and second image areas 102*b*. Further, for example, if a first image is applied to a first image area 102*a* and a second image is applied to a second images area 102*b*, then a third image is applied to a next image area of substrate 101, when comparing the third image and its respective print area to the second image and its respective image area, the second image area 102*b* may be considered as a first image area 102*a* and the image area associated with the third image may be considered as a second image area 102*b*, and so on.

The system 100 includes inkjets 103*a*-103*n* (collectively referred to as inkjet 103) that jet ink drops 104*a*-104*n* (collectively referred to as ink drop 104) such as a gel ink drop which may be a UV-curable gel ink, as discussed above. The ink drops 104 are applied to an image area of the substrate 101 in a printing zone 106.

The system 100 also includes a temperature variance device 105 that controls the temperature of the substrate 101 in the printing zone 106. The temperature variance device 105 may be configured to heat and/or cool the substrate 101 to achieve a selected temperature on demand by way of conduction, convection, radiation, or any combination thereof. In one or more embodiments, the temperature control device may comprise any number of rollers, belts, lamps, heating or cooling elements, heat sinks, etc. for controlling the temperature of the substrate 101 in the printing zone 106.

As discussed above, the inkjets 103 jet ink drops 104 onto the substrate 101 in the printing area 106 the ink drops 104 form one or more ink spots on an image area of the substrate 101. The ink spots have a determinable size, whether it be a diameter, for example, or if the ink spot is a line, a line width. An ideal or target spot size or line width that indicates an optimal ink spread resulting in minimal pin-hole and/or corduroy defects.

The target spot size may be determined, for example, based on any combination of features such as an ink drop 104 mass, a ratio of spot size to ink drop size (e.g., in flight diameter), a desired printed image resolution, a contact angle of the ink drop 104 with the substrate 101, and the like. Alternatively, the target spot size may be arbitrarily chosen and preset as the target spot size.

Different substrate types and coatings affect the spot size of the ink spots formed by the ink drops 104. For example, if a temperature of the substrate 101 is determined to be 35° C. in the printing zone 106, depending on the type and coating of the substrate 101, the determined ink spot size may vary among substrate type and/or coating (see FIG. 4 for a more detailed discussion below).

As such, by controlling the temperature of the substrate 101 in the printing zone 106, the spread of UV-curable gel ink can be optimized to achieve the target spot size to that gloss differential, missing inkjet visibility, corduroy defects, pin-hole defects, de-wetting issues, etc. can be minimized or eliminated regardless of substrate type and/or coating. Experimental results indicate that if a substrate's temperature is too high in the printing zone 106, the printed image is more likely to exhibit pin-hole defects, while if a temperature of the substrate 101 is too low, the printed image is likely to exhibit corduroy defects. Accordingly, the system 100 is configured to optimize the temperature of the substrate 101 in the printing zone 106 to produce a desired print quality which may be assessed based on a determined closeness or equality of a measured ink spot size to the established target spot size.

As such, according to various embodiments, the system 100 includes a temperature sensor 107 that determines a temperature of at least the image area of the substrate 101 in the printing zone 106. In one or more embodiments, the system 100 may also includes an image quality sensor 109 that measures the size of one or more ink spots formed by the ink drops 104 when they are jetted onto the substrate 101 in the printing zone 106 by the inkjets 103.

Accordingly, in one or more embodiments, after an image is printed onto the substrate 101, the temperature sensor 107 determines a temperature of at least the first image area 102*a* of the substrate 101 to which the ink drops 104 that form the printed image are applied when the substrate 101 is in the printing zone 106. In one embodiment, the image quality sensor 109, or a user, determines a spot size of one or more ink spots of an image in the first image area 102*a* on the substrate 101.

The system 100 may also comprise a controller 111 that causes the temperature variance device 105 to control the temperature of at least the second image area 102*b* of the substrate 101 to have another printed imaged applied to it by jetting ink drops 104 by the inkjets 103 when the second image area 102*b* of the substrate 101 is in the printing zone 106. The second image area 102*b* of the substrate 101 may be any of another portion of a webbed substrate 101, or another sheet among a series of sheeted substrate 101's, for example. The controller 111 determines a difference between the measured spot size and the target spot size and either causes the temperature variance device 105 to cause the temperature of the second image area 102*b* of the substrate 101 to be the same as the temperature of the first image area 102*a*, greater than the temperature of the first image area 102*a*, or less than the temperature of the first image area 102*a*.

For example, in one or more embodiments, the controller 111 may determine the target spot size whether it be by performing its own calculations, or by way of a manual input of target spot size by way of a user interface. The controller 111 may, in one embodiment, allow for a predetermined tolerance that is ± a specified amount of the target spot size before causing the temperature variance device 105 to increase or decrease the temperature of the substrate 101 in the printing zone 106 for a subsequent print. Or, the controller 111 may require a determined spot size to be exactly the same as the target spot size in order to maintain the substrate 101 temperature in the printing zone 106 for a subsequent print. In an embodiment that requires the determined spot size to be exactly the same as the target spot size, the predetermined tolerance, if any, is accordingly 0.

For example, if the controller 111 determines the first measured spot size is within the predetermined tolerance of the target spot size, the controller 111 causes the temperature of at least the second image area 102*b* of substrate 101 in the printing zone 106 to be equal to the temperature of the first image area 102*a* of substrate 101 in the printing zone 106.

Or, if the controller 111 determines the first measured spot size is outside the predetermined tolerance of the target spot size, the controller 111 causes the temperature of at least the second image area 102*b* substrate 101 in the printing zone 106 to be different from the temperature of the first image area 102*a* of substrate 101 in the printing zone 106. For example, if the first spot size is less than a low end of the predetermined tolerance, the temperature of at least the second image area 102*b* of substrate 101 image area in the printing zone 106 is caused to be greater than the temperature of the first image area 102*a* of substrate 101 in the printing zone 106. This is because if the spot size is determined to be less than the target spot size, this indicates a corduroy effect. Accordingly, by increasing the temperature of the substrate 101 in the printing zone 106, the UV-curable gel ink will be caused to spread more than it did in the previous print.

But, if the controller 111 determines that first spot size is greater than a high end of the predetermined tolerance, the controller 111 causes the temperature of at least the second image area 102*b* of substrate 101 in the printing zone 106 to be less than the temperature of the first image area 102*a* of substrate 101 in the printing zone 106. This is because if the temperature of the substrate 101 is too high in the printing zone 106, the ink spreads too much and results in pin-hole defects. Accordingly, by decreasing the temperature of the substrate 101 for a subsequent print in the printing zone 106, the ink will be caused to spread less than it did in the previous print.

The system 100 may, in some embodiments, be configured to enable a user to determine the spot size and determine whether the temperature of the substrate 101 should be adjusted, and as such cause a temperature adjustment by way of a user interface, for example. Additionally, the system 100 may continually run print after print until it hones in on the target spot size by continually adjusting the temperature of the substrate 101 in the printing area on demand. In one or more embodiments, the temperature may be determined and stored in a memory as an ideal temperature for subsequent print jobs having the same combination of substrate type and target spot size, for example. It should be noted that once the temperature is determined for achieving the target spot size, the system 100 may maintain that temperature, or continually vary that temperature based on printer performance during a print job.

The system 100 also comprising a curing station 113 that exposes any of UV-curable gel ink applied to the substrate 101 to UV light to cause any image applied to the substrate 101 to be cured and made permanent.

Figure 2:
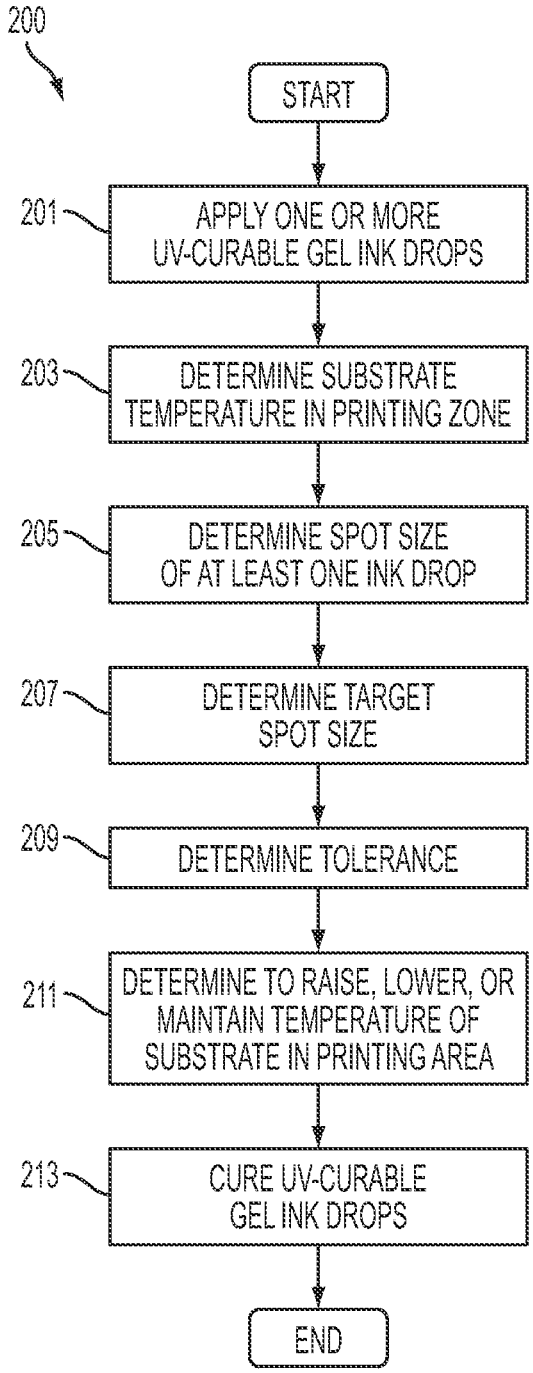
FIG. 2 is a flowchart of a process for controlling UV-curable gel ink spread of a printed image, according to one embodiment.
Figure 5:
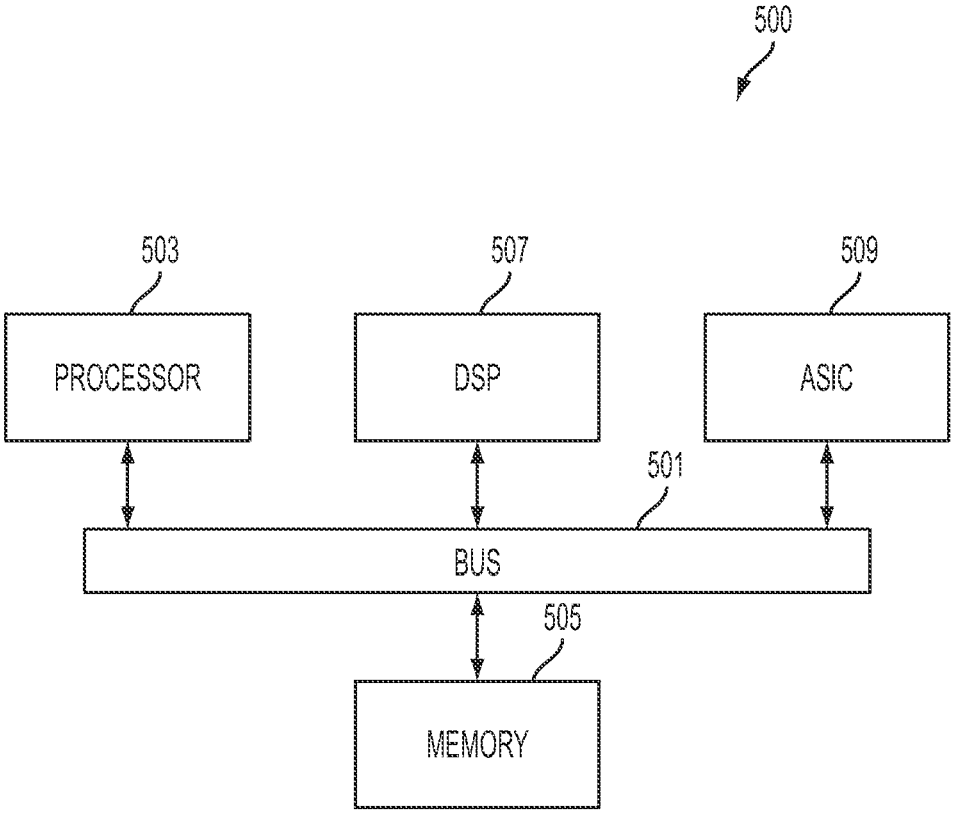
FIG. 5 is a diagram of a chip set that can be used to implement an embodiment.

FIG. 2 is a flowchart of a process for controlling UV-curable gel ink spread of a printed image, according to one embodiment. In one embodiment, the controller 111, which may be a control unit, or a control module implemented in, for instance, a chip set including a processor and a memory as shown in FIG. 5, performs the process 200. In step 201, the controller 111 causes, at least in part, one or more ink drops 104 to be applied to a first substrate image area 102*a* of substrate 101 by one or more inkjets 103 in a printing zone 106 of the print system 100 discussed above. As discussed above, the ink drops 104 may be UV-curable gel ink drops, for example. The one or more inkjets 103 are configured to form one or more first ink spots on the first substrate image area 102*a* of the substrate 101 when applying a first image, for example. Then, in step 203, the controller 111 determines a temperature of at least the first substrate image area 102*a* of the substrate 101 in the printing zone 106 by way of temperature sensor 107, discussed above. Next, in step 205, the controller 111 determines a first spot size of at least one of the one or more first ink spots.

The process continues to step 207 in which the controller 111 determines a target spot size to which the determined first spot size is to be compared. Next, in step 209, the controller 111 determines a predetermined tolerance for a difference between the determined first spot size and the target spot size. The tolerance may enable the determined spot size to be a range that is greater than or less than the target spot size, or be a 0 tolerance that requires the determined spot size to be equal to the target spot size.

Then, in step 211, depending on whether the controller 111 determines the first spot size to fall within the predetermined tolerance, be equal to the target spot size, or is greater than a high end of the tolerance or low end of the tolerance, the controller 111 causes either (1) the temperature of at least the second image area 102*b* in the printing zone 106 to be equal to the temperature of the first image area 102*a* in the printing zone if the determined spot size is within the predetermined tolerance or equal to the target spot size, (2) causes the temperature of at least the second image area 102*b* in the printing zone 106 to be greater than the temperature of the first substrate image area 102*a* in the printing zone 106 if the first spot size is less than a low end of the predetermined tolerance or (3) causes the temperature of at least the second image area 102*b* in the printing zone 106 to be less than the temperature of the first substrate image area 102*a* in the printing zone 106 if the first spot size is greater than a high end of the predetermined tolerance. In other words, the controller 111 causes the temperature of at least a second image area 102*b* in the printing zone 106 to be based on the determined first spot size.

Next, in step 213, the controller 111 causes the UV curing station 113 to expose the UV-curable gel ink applied to the substrate 101 to UV light to cause the UV-curable gel ink to be finally cured.

Figure 3:
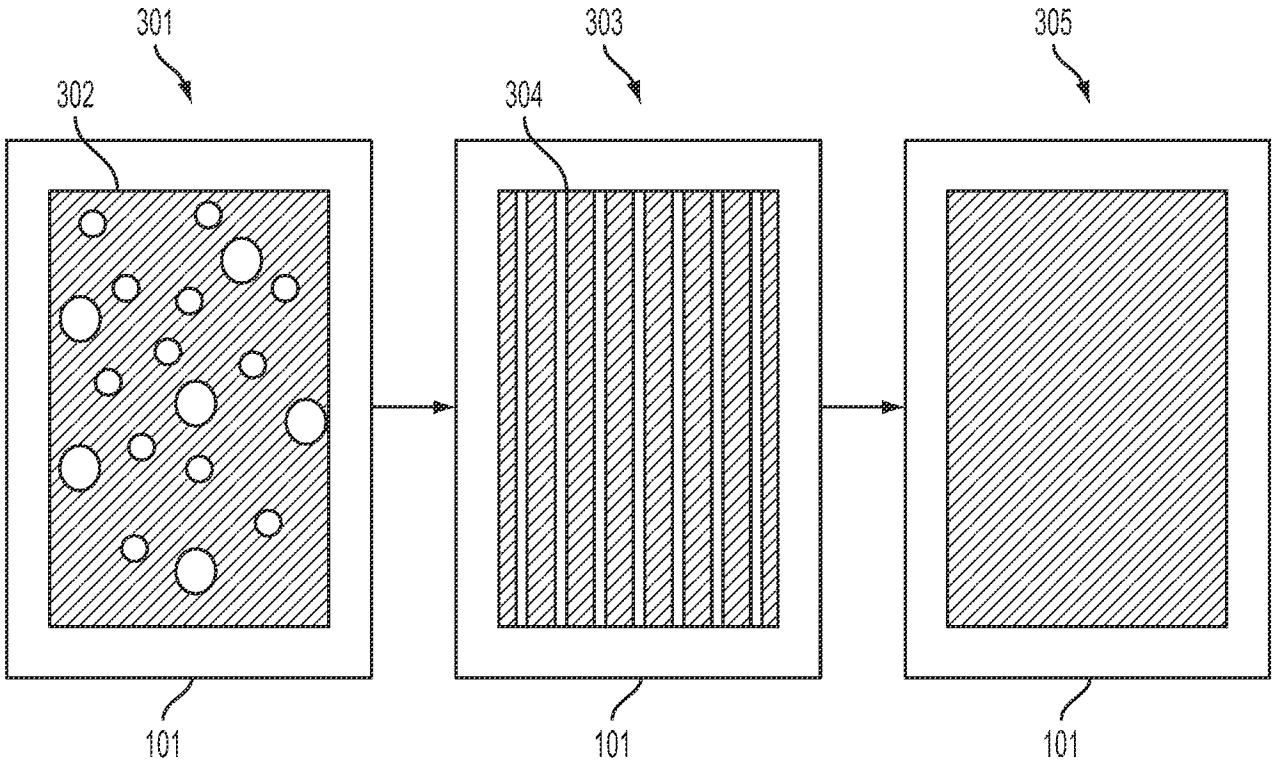
FIG. 3 illustrates a progression of UV-curable gel ink spread correction, according to one embodiment.

FIG. 3 illustrates an example progression of temperature adjustments of at least the images areas of a substrate 101 in the printing zone 106, as discussed above. The system 100, discussed above, applied an image 301 to a first image area 102*a* of substrate 101, when substrate 101 was at too high of a temperature in the printing zone 106. As such, the high temperature in the printing zone caused various pin-hole defects 302. The controller 111 determined that the spot sizes were greater than the target spot size and accordingly instructed the temperature variance device 105 to reduce the temperature of the substrate 101 when applying the image 303 to a second image area 102*b* of substrate 101. However, the temperature of the second image area 102*b* of substrate 101 in the printing zone 106 was too low. As such, the image 303 has various corduroy defects 304 within it. Accordingly, the controller 111 determined the presence of the corduroy defects 304 because the determined spot size was smaller than the target spot size. The controller 111, therefore caused the temperature variance device 105 to increase the temperature of the substrate 101 when applying the image 305 to a value between the first temperature that caused pin-hole defects 302 and the second temperature that caused the corduroy defects 304 resulting in an image 305 that does not exhibit, or has very little image defects that result from inadequate ink spread.

As an example, as discussed above, the second print area 102*b* which has the image 303 applied to it becomes the first print area 102*a* for temperature and spot size determination purposes for a subsequent printed image as substrate 101 is advanced through the system 100 so that the image 305 may be applied to a subsequent image area which becomes the second image area 102*b* for temperature adjustment. It should be noted that the above progression is merely exemplary and may occur in any order and require any number of iterations.

Figure 4:
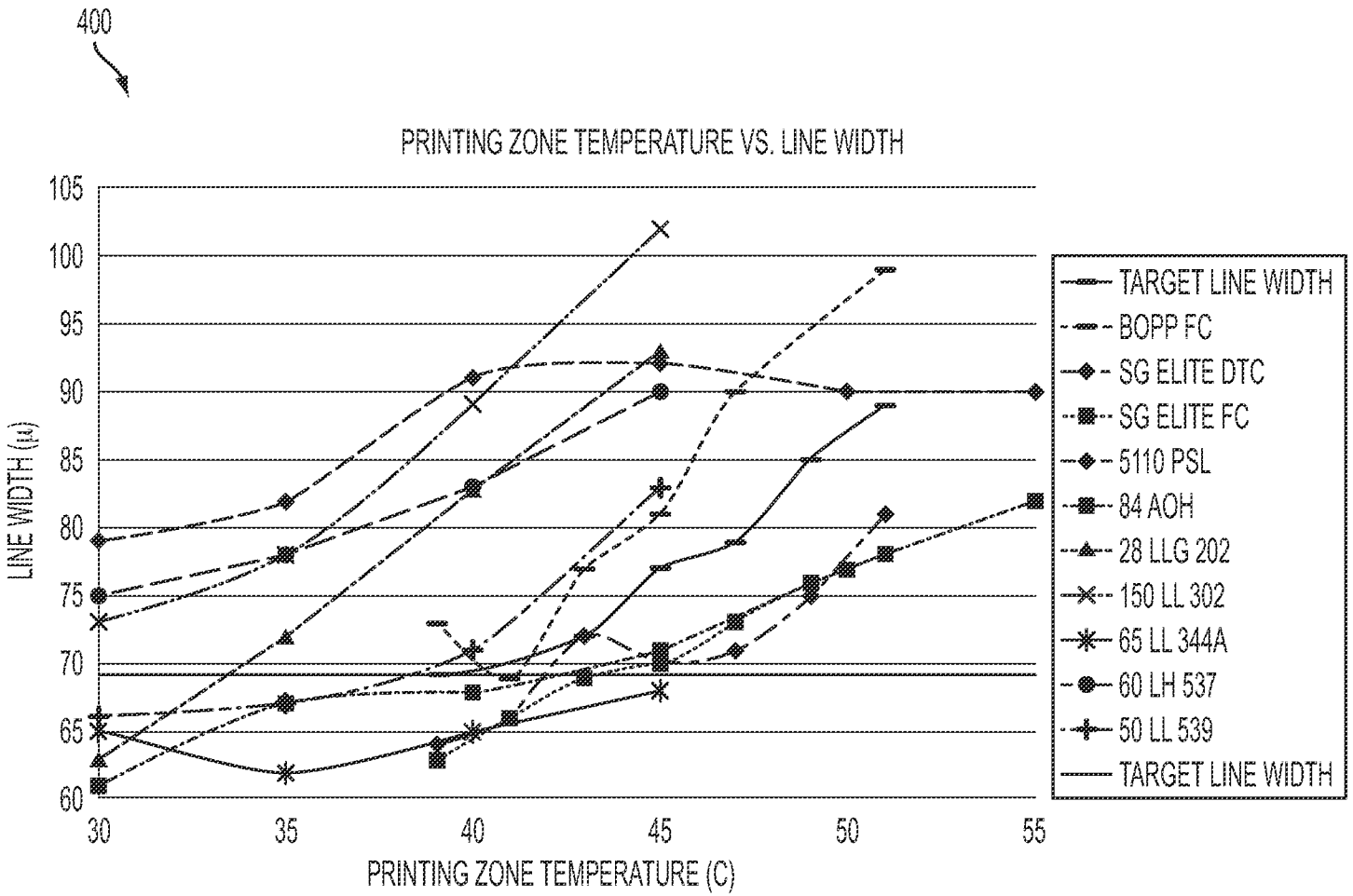
FIG. 4 illustrate a graph showing the effects that substrate type and/or coating has on UV-curable gel ink spread, according to one embodiment.

FIG. 4 illustrates a graph 400 showing the effects that substrate type has on UV-curable gel ink spread and the determined spot size of the one or more UV-curable gel ink spots when applied to a particular substrate at various temperatures in the printing zone. In this example, the initial drop mass of the UV-curable gel ink applied to the substrate 101 is 17 ng with a desired ratio of spot size (i.e. ink on media diameter) to drop size (ink drop in flight diameter) of 250% and y-resolution of about 400 dpi. The target spot size (or line width in this example) is 69 microns.

In this example, though the target spot size is 69 microns, if the determined temperature of the substrate 101 is 35° C. in the printing zone 106, discussed above, the determined target spot size varies by substrate type and/or coating. For example, for substrate SG Elite DTC, the determined spot size according to the graph illustrated is about 82 microns. But, for a substrate 65 LL 344A, the determined spot size is about 62 microns.

The system 100, discussed above, accordingly controls the temperature of the substrate 101 in the printing zone 106 to achieve the established target spot size to reduce or eliminate image related defects regardless of substrate type and/or coating.

For example, Table 1-1 below illustrates a subset of the DTC media from the above-discussed graph. The Data Driven Selection in Table 1-1 is from where the SG Elite media with DTC and Flexographic coatings and BOPP DTC cross the 69 micron target line. Table 1-1 indicates that temperatures of about 41° C. for BOPP DTC, 45° C. for SGE DTC, 43° C. for SGE FC with the flexographic coating achieve the target spot size within an allowable tolerance.

TABLE 1-1

| | Data Driven Selection | | | | Visual Inspection Selection | | | |
|---|---|---|---|---|---|---|---|---|
| | Calculated | | | | Calculated | | | |
| Media | Temp | θ | SS/DS (%) | Measured LW (μ) | Temp | θ | SS/DS (%) | Measured LW (μ) |
| BOPP FC | 41 | 19 | 232 | 69 | 43 | 15 | 270 | 77 |
| SGE DTC | 45 | 18 | 257 | 70 | 41 | 21 | 241 | 72 |
| SGE FC | 43 | 19 | 251 | 69 | 43 | 19 | 251 | 69 |

In this example, the system 100 varies the temperature of the substrate 101 to achieve the target spot size. The temperatures illustrated are merely exemplary and are used to indicate that temperature of the substrate 101 in the printing zone 106 has an effect on spot size. The temperatures for any substrate type may be varied to achieve a target spot size of any magnitude, as discussed above.

The processes described herein for controlling UV-curable gel ink spread of a printed image may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 5 illustrates a chip set or chip 500 upon which an embodiment may be implemented. Chip set 500 is programmed to control UV-curable gel ink spread of a printed image as described herein may include, for example, bus 501, processor 503, memory 505, DSP 507 and ASIC 509 components.

The processor 503 and memory 505 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 500 can be implemented in a single chip. It is further contemplated that in certain embodiments the chip set or chip 500 can be implemented as a single "system on a chip." It is further contemplated that in certain embodiments a separate ASIC would not be used, for example, and that all relevant functions as disclosed herein would be performed by a processor or processors. Chip set or chip 500, or a portion thereof, constitutes a means for performing one or more steps of controlling UV-curable gel ink spread of a printed image.

In one or more embodiments, the chip set or chip 500 includes a communication mechanism such as bus 501 for passing information among the components of the chip set 500. Processor 503 has connectivity to the bus 501 to execute instructions and process information stored in, for example, a memory 505. The processor 503 may include one or more processing cores with each core configured to perform independently. A multi-core processor enables multiprocessing within a single physical package. Examples of a multi-core processor include two, four, eight, or greater numbers of processing cores. Alternatively or in addition, the processor 503 may include one or more microprocessors configured in tandem via the bus 501 to enable independent execution of instructions, pipelining, and multithreading. The processor 503 may also be accompanied with one or more specialized components to perform certain processing functions and tasks such as one or more digital signal processors (DSP) 507, or one or more application-specific integrated circuits (ASIC) 509. A DSP 507 typically is configured to process real-world signals (e.g., sound) in real time independently of the processor 503. Similarly, an ASIC 509 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 503 performs a set of operations on information as specified by computer program code related to controlling UV-curable gel ink spread of a printed image. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 501 and placing information on the bus 501. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 503, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 503 and accompanying components have connectivity to the memory 505 via the bus 501. The memory 505 may include one or more of dynamic memory (e.g., RAM, magnetic disk, writable optical disk, etc.) and static memory (e.g., ROM, CD-ROM, etc.) for storing executable instructions that when executed perform the inventive steps described herein to control UV-curable gel ink spread of a printed image. The memory 505 also stores the data associated with or generated by the execution of the inventive steps.

In one or more embodiments, the memory 505, such as a random access memory (RAM) or any other dynamic storage device, stores information including processor instructions for controlling UV-curable gel ink spread of a printed image. Dynamic memory allows information stored therein to be changed by system 100. RAM allows a unit of information stored at a location called a memory address to be stored and retrieved independently of information at neighboring addresses. The memory 505 is also used by the processor 503 to store temporary values during execution of processor instructions. The memory 505 may also be a read only memory (ROM) or any other static storage device coupled to the bus 501 for storing static information, including instructions, that is not changed by the system 100. Some memory is composed of volatile storage that loses the information stored thereon when power is lost. The memory 505 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 503, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method of controlling ultraviolet-curable gel ink spread of a printed image comprising:

applying one or more ultraviolet-curable gel inks to a first substrate image area by one or more inkjets in a printing zone of a printer, the one or more inkjets being configured to form one or more first ink spots on the first substrate image area;

determining, with a processor, a temperature of at least the first substrate image area in the printing zone;

determining, with the processor, a first spot size of at least one of the one or more first ink spots;

referencing, with the processor, a target spot size for the one or more first ink spots;

comparing, with the processor, the determined first spot size with the referenced target spot size for the one or more first ink spots;

adjusting, with the processor, a temperature of at least a second substrate image area in the printing zone based on the comparing; and exposing the one or more ultraviolet-curable gel inks to an ultraviolet light to cure the one or more ultraviolet-curable gel inks.

2. The method of claim 1, further comprising:

determining from the comparing, with the processor, that the first spot size is within a predetermined tolerance of the target spot size; and adjusting, with the processor, the temperature of at least the second substrate image area in the printing zone to be equal to the temperature of the first substrate image area in the printing zone.

3. The method of claim 1, further comprising:

determining from the comparing, with the processor, that the first spot size is outside a predetermined tolerance of the target spot size; and adjusting, with the processor, the temperature of at least the second substrate image area in the printing zone to be different from the temperature of the first substrate image area in the printing zone.

4. The method of claim 3, further comprising:

determining from the comparing, with the processor, that the first spot size is less than a low end of the predetermined tolerance; and adjusting, with the processor, the temperature of at least the second substrate image area in the printing zone to be greater than the temperature of the first substrate image area in the printing zone.

5. The method of claim 3, further comprising:

determining from the comparing, with the processor, that the first spot size is greater than a high end of the predetermined tolerance; and adjusting, with the processor, the temperature of at least the second substrate image area in the printing zone to be less than the temperature of the first substrate image area in the printing zone.

6. The method of claim 1, the temperature of the first substrate image area in the printing zone and the temperature of the second substrate image area in the printing zone being controlled by a temperature variance device configured to adjust the temperature of a substrate in the printing zone.

7. The method of claim 6, the temperature variance device controlling the temperature of the substrate in the printing zone via at least one of conduction, convection, and radiation.

8. An apparatus for controlling ultraviolet-curable gel ink spread of a printed image comprising:

one or more inkjets that apply one or more ultraviolet-curable gel inks to form one or more first ink spots on a substrate;

at least one temperature variance device that adjusts a temperature of the substrate in a printing zone of a printer;

at least one temperature sensor that senses a temperature of the substrate in the printing zone;

at least one ultraviolet light source that cures the one or more ultraviolet-curable gel inks on the substrate; and a processor that is programmed to direct the application of the one or more ultraviolet-curable gel inks to a first substrate image area by the one or more inkjets in the printing zone;

obtain, from the at least one temperature sensor, a temperature of at least the first substrate image area in the printing zone;

determine a first spot size of at least one of the one or more first ink spots;

reference a target spot size for the one or more first ink spots;

compare the determined first spot size with the referenced target spot size for the one or more first ink spots;

adjust a temperature of at least a second substrate image area in the printing zone based on the comparison; and direct an exposing of the one or more ultraviolet-curable gel inks by the ultraviolet light source to cure the one or more ultraviolet-curable gel inks.

9. The apparatus of claim 8, the processor being further programmed to:

determine from the comparison that the first spot size is within a predetermined tolerance of the target spot size; and adjust the temperature of at least the second substrate image area in the printing zone to be equal to the temperature of the first substrate image area in the printing zone.

10. The apparatus of claim 8, the processor being further programmed to:

determine from the comparison that the first spot size is outside a predetermined tolerance of the target spot size; and adjust the temperature of at least the second substrate image area in the printing zone to be different from the temperature of the first substrate image area in the printing zone.

11. The apparatus of claim 10, the processor being further programmed to:

determine from the comparison that the first spot size is less than a low end of the predetermined tolerance; and adjust the temperature of at least the second substrate image area in the printing zone to be greater than the temperature of the first substrate image area in the printing zone.

12. The apparatus of claim 10, the processor being further programmed to:

determine from the comparison that the first spot size is greater than a high end of the predetermined tolerance; and adjust the temperature of at least the second substrate image area in the printing zone to be less than the temperature of the first substrate image area in the printing zone.

13. The apparatus of claim 8, the temperature variance device controlling the temperature of the substrate in the printing zone via at least one of conduction, convection, and radiation.

14. A non-transitory computer-readable storage medium on which is recorded instructions that, when executed by a processor, cause the processor to execute a method for controlling ultraviolet-curable gel ink spread of a printed image, the method comprising:

applying one or more ultraviolet-curable gel inks to a first substrate image area by one or more inkjets in a printing zone of a printer, the one or more inkjets being configured to form one or more first ink spots on the first substrate image area;

determining a temperature of at least the first substrate image area in the printing zone;

determining a first spot size of at least one of the one or more first ink spots;

referencing a target spot size for the one or more first ink spots;

comparing the determined first spot size with the referenced target spot size for the one or more first ink spots;

adjusting a temperature of at least a second substrate image area in the printing zone based on the comparing; and exposing the one or more ultraviolet-curable gel inks to be exposed to an ultraviolet light to cure the one or more ultraviolet-curable gel inks.

15. The non-transitory computer-readable storage medium of claim 14, the method further comprising:

determining from the comparing that the first spot size is within a predetermined tolerance of the target spot size; and adjusting the temperature of at least the second substrate image area in the printing zone to be equal to the temperature of the first substrate image area in the printing zone.

16. The non-transitory computer-readable storage medium of claim 14, the method further comprising:

determining from the comparing that the first spot size is outside a predetermined tolerance of the target spot size; and adjusting the temperature of at least the second substrate image area in the printing zone to be different from the temperature of the first substrate image area in the printing zone.

17. The non-transitory computer-readable storage medium of claim 16, the method further comprising:

determining from the comparing that the first spot size is less than a low end of the predetermined tolerance; and adjusting the temperature of at least the second substrate image area in the printing zone to be greater than the temperature of the first substrate image area in the printing zone.

18. The non-transitory computer-readable storage medium of claim 16, the method further comprising:

determining from the comparing that the first spot size is greater than a high end of the predetermined tolerance; and adjusting the temperature of at least the second substrate image area in the printing zone to be less than the temperature of the first substrate image area in the printing zone.

19. The non-transitory computer-readable storage medium of claim 14, the temperature of the first substrate image area in the printing zone and the temperature of the second substrate image area in the printing zone are controlled by a temperature variance device configured to adjust the temperature of a substrate in the printing zone.

* * * * *